US010400792B2

(12) United States Patent
Sierakowski-Larsen

(10) Patent No.: US 10,400,792 B2
(45) Date of Patent: Sep. 3, 2019

(54) CENTRIFUGAL PUMP ASSEMBLY COMPRISING AT LEAST ONE IMPELLER PRODUCING FLOW THROUGH AND AN ANNULAR SPACE DIVIDED BY AT LEAST TWO GUIDE VANES INTO PART-ANNULAR-SPACES

(71) Applicant: GRUNDFOS HOLDING A/S, Bjerringbro (DK)

(72) Inventor: Janus Lukas Sierakowski-Larsen, Langå (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 291 days.

(21) Appl. No.: 15/294,020

(22) Filed: Oct. 14, 2016

(65) Prior Publication Data

US 2017/0108007 A1 Apr. 20, 2017

(30) Foreign Application Priority Data

Oct. 15, 2015 (EP) ..... 15189912

(51) Int. Cl.

| | |
|---|---|
| ***F04D 1/06*** | (2006.01) |
| ***F04D 13/06*** | (2006.01) |
| ***F04D 29/42*** | (2006.01) |
| ***F04D 29/44*** | (2006.01) |
| ***F04D 29/58*** | (2006.01) |

(52) U.S. Cl.

CPC ..... *F04D 29/5806* (2013.01); *F04D 1/06* (2013.01); *F04D 13/06* (2013.01); *F04D 29/426* (2013.01); *F04D 29/445* (2013.01); *F04D 29/448* (2013.01); *F05D 2250/52* (2013.01)

(58) Field of Classification Search

CPC ..... F04D 1/06; F04D 13/06; F04D 29/406; F04D 29/426; F04D 29/445; F04D 29/448; F04D 29/5806; F04D 29/22; F05D 2250/52

USPC ..... 417/366, 368, 423.8, 423.14, 423.1

See application file for complete search history.

(56) References Cited

U.S. PATENT DOCUMENTS 4,257,745 A * 3/1981 Thur ..... F04D 13/16 417/18
5,494,403 A * 2/1996 Kobayashi ..... F04D 1/006 415/102

FOREIGN PATENT DOCUMENTS

| | | |
|---|---|---|
| DE | 694 06 259 T2 | 5/1998 |
| EP | 0 831 236 A2 | 3/1998 |
| EP | 1 217 217 A1 | 6/2002 |
| JP | S51 154703 U | 12/1976 |

* cited by examiner

*Primary Examiner* — Kenneth J Hansen
*Assistant Examiner* — Benjamin Doyle
(74) *Attorney, Agent, or Firm* — McGlew and Tuttle, P.C.

(57) ABSTRACT

A water supply system (1) includes an electric motor (8) and a centrifugal pump (7) which is driven by the electric motor (8) and with at least one impeller (10) which produces a main delivery flow (29) through an annular space (12) as well as a cooling fluid delivery flow (30) through a space (28) surrounding the motor (8). The annular space (12) is divided by two guide vanes into part-annular-spaces (23, 24) which have a different pressure level on operation. Each part-annular-space (23, 24) is conductively connected to the space (28) which surrounds the motor (8) and through which the cooling fluid runs (FIG. 5).

20 Claims, 5 Drawing Sheets

CENTRIFUGAL PUMP ASSEMBLY COMPRISING AT LEAST ONE IMPELLER PRODUCING FLOW THROUGH AND AN ANNULAR SPACE DIVIDED BY AT LEAST TWO GUIDE VANES INTO PART-ANNULAR-SPACES

CROSS REFERENCE TO RELATED APPLICATIONS

This application claims the benefit of priority under 35 U.S.C. § 119 of European Application 15 189 912.7 filed Oct. 15, 2015, the entire contents of which are incorporated herein by reference.

FIELD OF THE INVENTION

The invention relates to a centrifugal pump assembly, in particular as part of a water supply system, and which comprises a single-stage or multi-stage centrifugal pump driven by an electric motor.

BACKGROUND OF THE INVENTION

It is counted as belonging to the state of the art with centrifugal pump assemblies, to lead the delivery flow of the pump along the motor, in order to dissipate the heat produced by the drive motor, so that this motor does not overheat. Such arrangements in particular are known with centrifugal pump assemblies for delivering cold water.

The application of such centrifugal pumps in water supply systems or pressure boosting installations is counted as belonging to the state of the art. With a water supply system which is marketed by the Applicant under the description "GRUNDFOS MQ", a multi-stage centrifugal pump is arranged in a lying manner, i.e. with a horizontal axis, and which designed in a multi-stage manner and comprises a channel routing within the water supply system, with which water delivered by the pump is delivered from the last pump stage into an annular space which surrounds the electric motor and onto which a channel in turn connects, said channel leading to the exit connection or delivery connection of the water supply system. The design measures which are implemented there for cooling the motor have definitely proven their worth, since the main delivery flow flows along the outer side of the electric motor and thus continuously ensures an adequate cooling. The design of this known water supply system is comparatively complicated, which is why one strives to simplify this, so that the water supply system can be manufactured more economically and can be designed in a technologically more advantageous manner with regard to application. If however, one desires to fundamentally depart from the known design principle, then this also entails a change of the cooling concept for the electric motor.

SUMMARY OF THE INVENTION

Against this background, it is an object of the present invention, to design a centrifugal pump assembly, in particular as part of a water supply system, such that the electric motor is adequately cooled without the main delivery flow having to be led along the electric motor.

The object of the invention is achieved by a centrifugal pump assembly with the features according to the invention, and, inasmuch as it concerns an application on the part of a water supply system, by a water supply system with the features according to the invention. A water supply system in the context of the present invention is also a pressure booster installation.

The centrifugal pump assembly according to the invention, which in particular forms part of a water supply system, comprises an electric motor and a single-stage or multi-stage centrifugal pump which is driven by this and which is with at least one impeller producing a main delivery flow through an annular space surrounding the at least one pump stage, as well as a cooling fluid delivery flow through a space surrounding the motor. Thereby, the annular space is subdivided by at least two guide vanes into part-annular-spaces which on operation have a different pressure level and each of these part-annular-spaces is conductively connected to the space surrounding the motor.

The basic concept of the solution according to the invention, from the start is to only use a part-flow of the fluid delivered by the centrifugal pump for cooling the motor, in order in this manner to have more freedom with regard to design and fashioning with the channel (passage) routing. Thus, a main delivery flow is produced through an annular space surrounding the at least one pump stage, i.e. the main delivery flow at the end of the pump is led through this annular space in the direction of the suction side of the pump, so that the main channel guidance/routing is effected essentially in the region of the pump and not at the motor side. A cooling fluid delivery flow however is branched from the main delivery flow and is led through a space surrounding the motor, in order to reliably and securely cool the electric motor.

A difference in the pressure level is produced in the annular space which surrounds the at least one pump stage by way of at least two guide vanes being provided and these guide vanes dividing at least parts of this annular space in to part-annular-spaces which have a different pressure level on operation, for producing the cooling fluid delivery flow. Thereby, according to the invention, these part-annular-spaces are each fluid conductively connected (fluidically connected) to the space surrounding the motor. A targeted flow in the space surrounding the motor is produced by way of the pressure difference between the part-annular-spaces which, even if only small, sets in on operation, and thus the necessary cooling delivery flow is ensured.

This design measure on the one hand ensures a secure cooling of the electric motor, but one the other hand permits the channel routing to be designed such that the pump entry and pump exit lie on the same side and that at least the main delivery flow is led back again in the direction of the pump entry, through an annular space surrounding the at least one pump stage. A very compact design is possible due to this, in particular if the centrifugal pump assembly according to the invention forms part of a water supply system. The effect of the different pressure level in the two part-spaces particularly forms if the centrifugal pump assembly is operated in a lying manner, i.e. with a horizontal axis of the pump and motor. A greater pressure level in the lower part of the annular space than in the upper part-annular-space can then exist, by which means this cooling fluid delivery flow through the space surrounding the motor is produced. This effect however can also be achieved if the axis is not arranged horizontally, this requires however that the hydraulic resistances of the connections between each of the two part spaces pressure port is different.

According to a further development of the invention, the guide vanes advantageous form part of the last pump stage or are arranged after this. They are preferably arranged diametrically in the annular space and specifically in a manner such that they form an imagined dividing or partition plane which divides the annular space of the pump at least partly in, a preferable essentially horizontal manner.

The annular space which surrounds the at least one pump stage is advantageously at least partly delimited by the pump casing. The design according to the invention can then be effected largely using components which are present in any case.

With a multi-stage design of the centrifugal pump, it is thereby particularly advantageous if the last pump stage is formed by the impeller with the surrounding, normal guide vanes dividing the annular space in the pump casing, and the first and, as the case may be, further pump stages are arranged therebetween within a cylinder jacket inwardly delimiting the annular space of the pump and being divided in the axial direction at least in sections by the guide vanes. Divided in the axial direction is to be understood in that the dividing plane formed by the guide vanes runs through the pump axis or parallel thereto and is preferably arranged in a horizontal manner.

Advantageously, these guide vanes dividing the annular space are designed and arranged such that they extend in the direction of the rotation axis of the impeller or in a direction parallel thereto, and thus project into the annular space, this simultaneously form part of the diffuser for the last pump stage and dividing means for producing the pressure difference for the cooling fluid delivery flow. The guide vanes preferably extend into the region between the impeller and a face wall, preferably the face wall delimiting the pump casing, and specifically to the face wall which is close to the electric motor. A comparably high pressure difference of the part-annular-spaces is achieved by way of this, since typically no hydraulic short circuit can arise in this region. Thereby, the conduit connections to the space surrounding the motor are preferably typically formed by recesses in this face wall of the pump casing.

According to an advantageous further design of the invention, the guide vanes forming the part-annular-spaces extend radially along the face wall of the pump casing which faces the electric motor, as well as axially along an outer wall outwardly delimiting the annular space, preferably of the pump casing. Thus, on the one hand they form part of the diffuser of the last pump stage and on the other hand walls which delimit the part-annular-spaces to one another. Thereby, these guide vanes are advantageously designed as one piece with the pump casing which comprises the face wall to the electric motor as well as the surrounding outer wall.

With the channel routing which is described above and with which the delivery fluid is delivered from the suction port of the first pump stage up to the impeller of the last pump stage essentially in the axis direction of the pump and then through the annular channel in the opposite direction, it is particularly advantageous to design the pump as a radial centrifugal pump or a radial/axial centrifugal pump.

The pump is advantageously envisaged and designed for operation with a horizontally arranged rotation axis, wherein the guide vanes which divide the annular space of the pump extend essentially in a horizontal plane, in which the rotation axis also lies or runs parallel and/or slightly obliquely thereto (up to maximal 30 thereto).

Thereby, it is advantageous if the motor and the pump comprise a common shaft, and the annular space of the pump is arranged aligned to the space which surrounds the motor and which is likewise designed as an annular space.

The designs which are described above are particularly advantageous with the application of the centrifugal pump assembly according to the invention in a water supply system. The water supply system can be designed in a significantly more favorable manner by way of these design features, and specifically with regard to the manufacture and assembly as well as its handing. Thus, the water supply system according to the invention comprises such a centrifugal pump assembly and has its suction connection and delivery connection arranged at the same side, preferably above one another at a face side of the surrounding housing. This arrangement is possible since the delivery flow through the annular space of the pump is led back in the direction of the suction side, so that the delivery connection of the water supply system can be at the same side as the suction connection, without complicated internal channel/passage guidance.

According to an advantageous further development of the invention, the water supply system comprises a surrounding housing, in which the pump and motor are arranged at the bottom and a diaphragm tank and the motor electronics are arranged thereabove and at the top. Thereby, the motor electronics are advantageously arranged above the motor, and the diaphragm tank above the pump. Electrical and hydraulic subassemblies can be spatially separated from one another in this manner, also within the housing of the water supply system, and this is advantageous. Thereby, the channel routing in an advantageous further formation can be relocated to the side of the pump casing, at which the suction and delivery connection are located.

The invention is hereinafter explained in more detail by way of one embodiment example which is represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
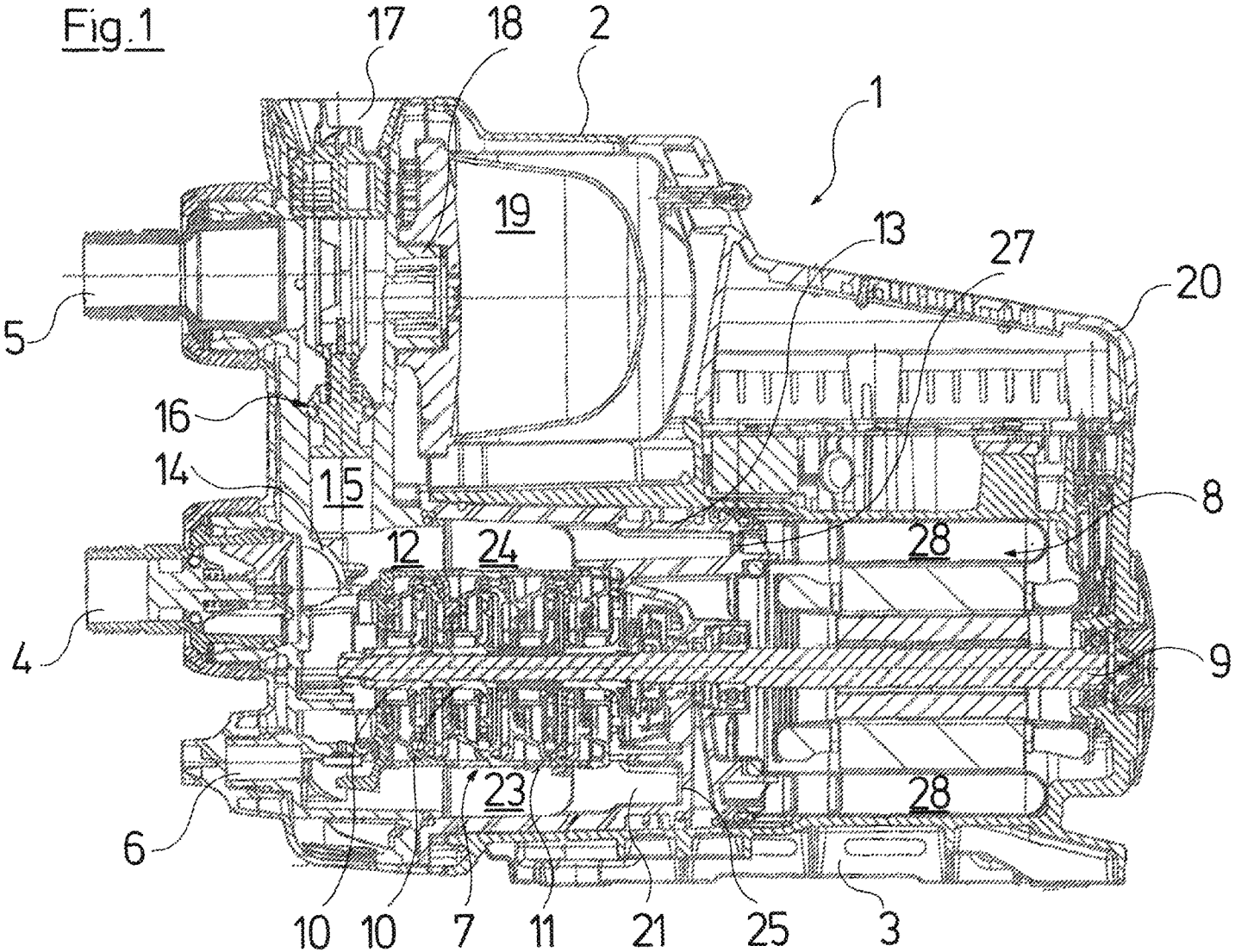
FIG. 1 is a greatly simplified longitudinal sectional view of a water supply system with a centrifugal pump.
Figure 2:
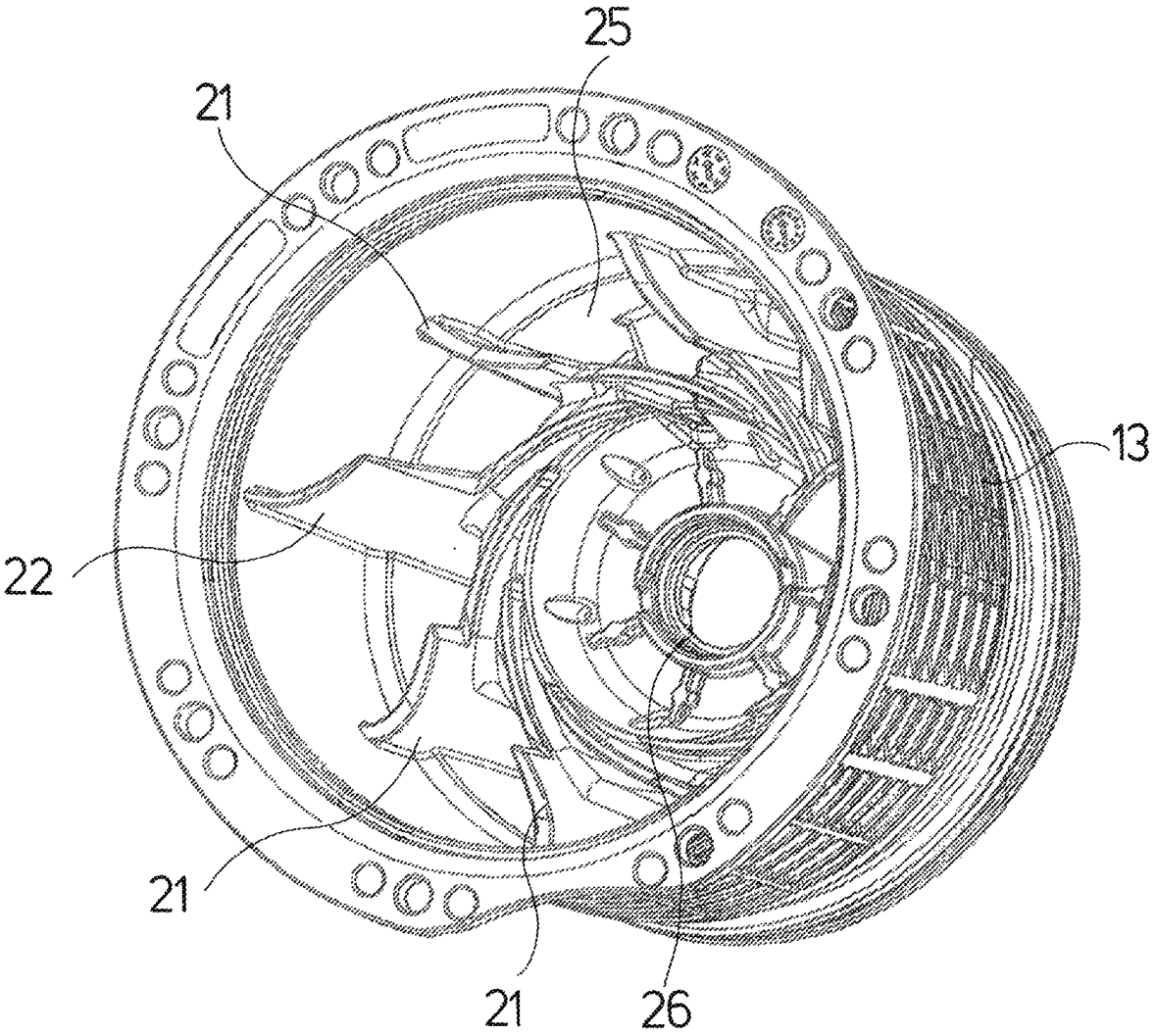
FIG. 2 is a perspective view of a part of the pump casing within the water supply system.
Figure 3:
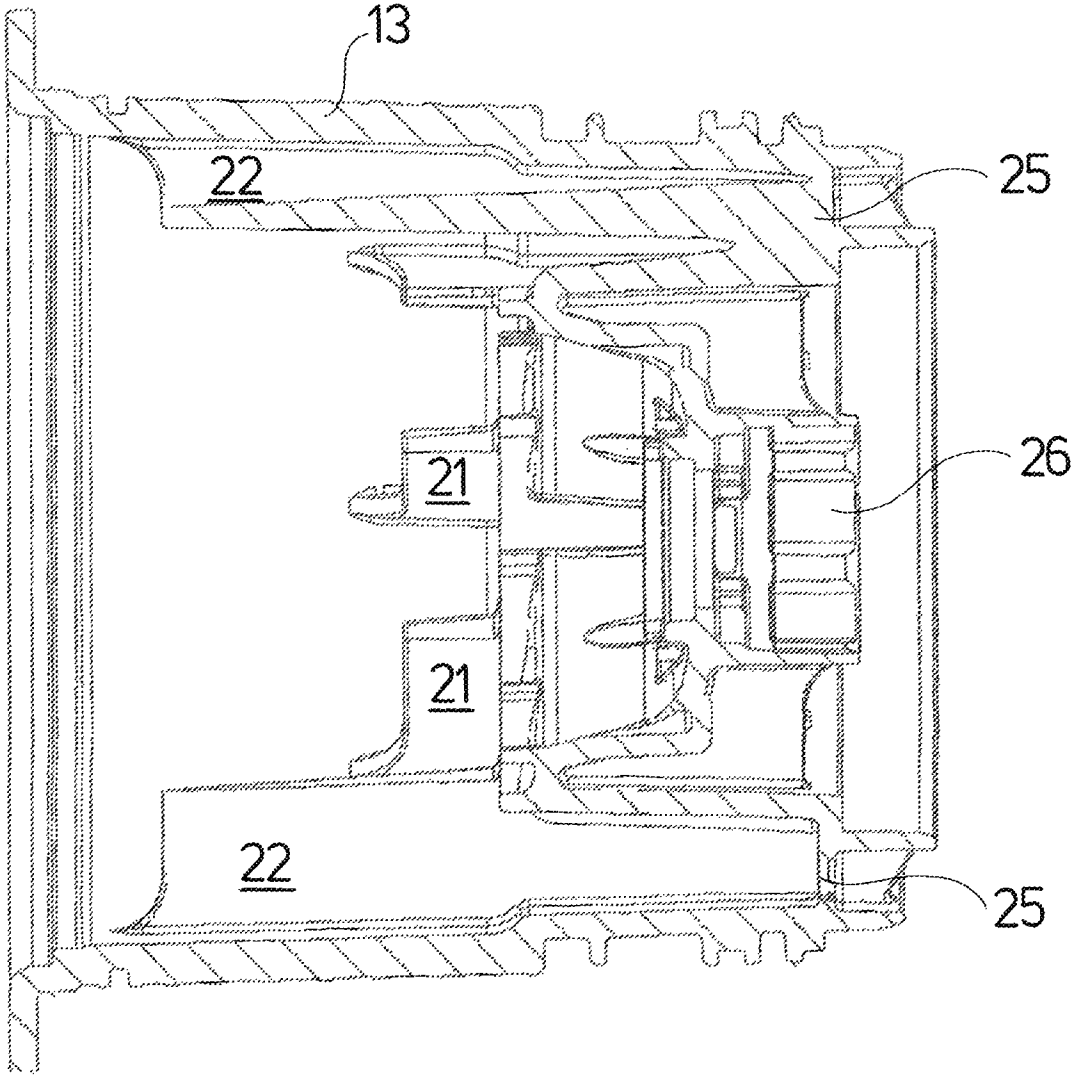
FIG. 3 is a longitudinal sectional view of the part of the pump casing according to FIG. 2.
Figure 4:
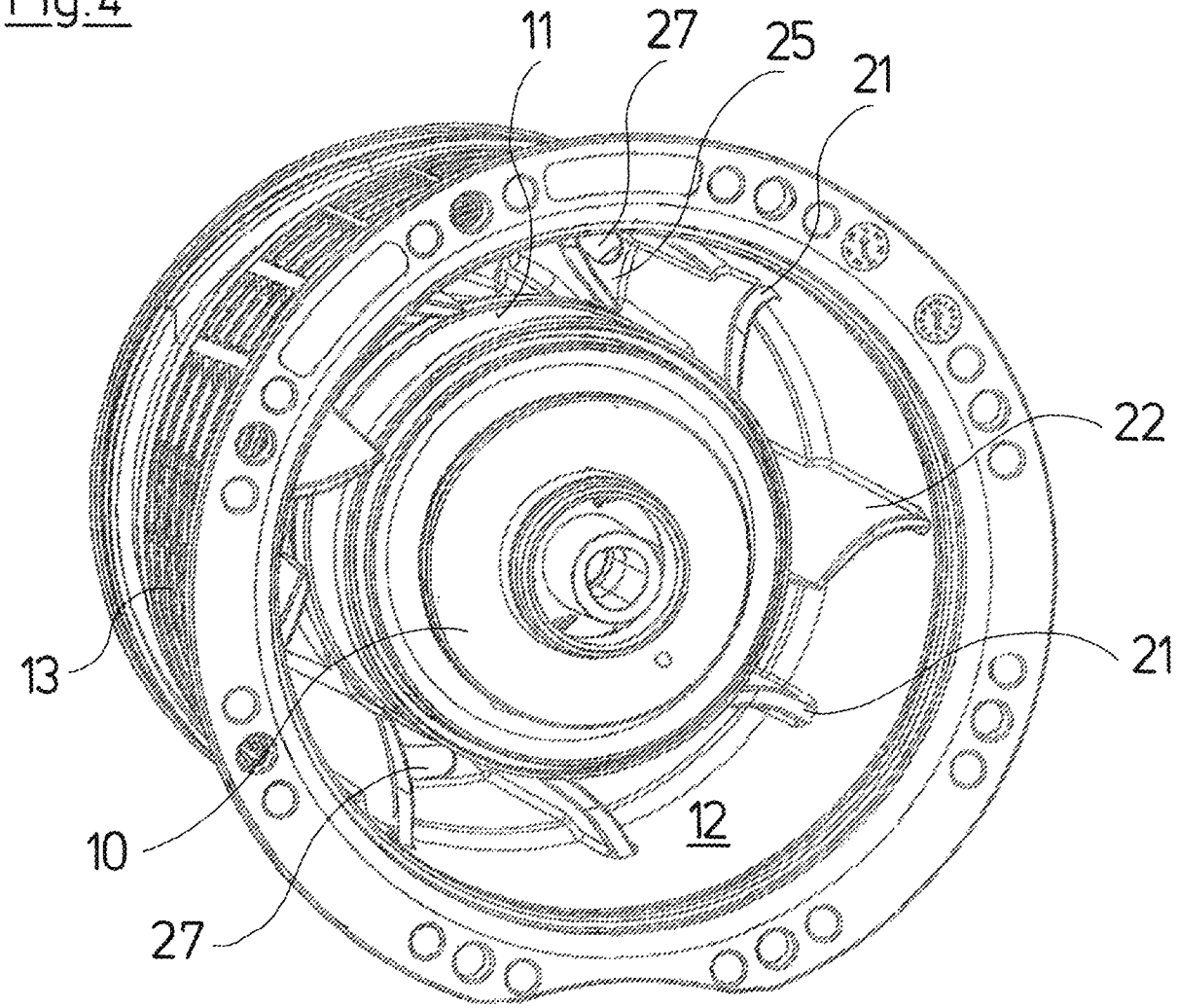
FIG. 4 is a perspective representation of the part of the pump casing according to FIG. 3, with pump stages arranged therein.
Figure 5:
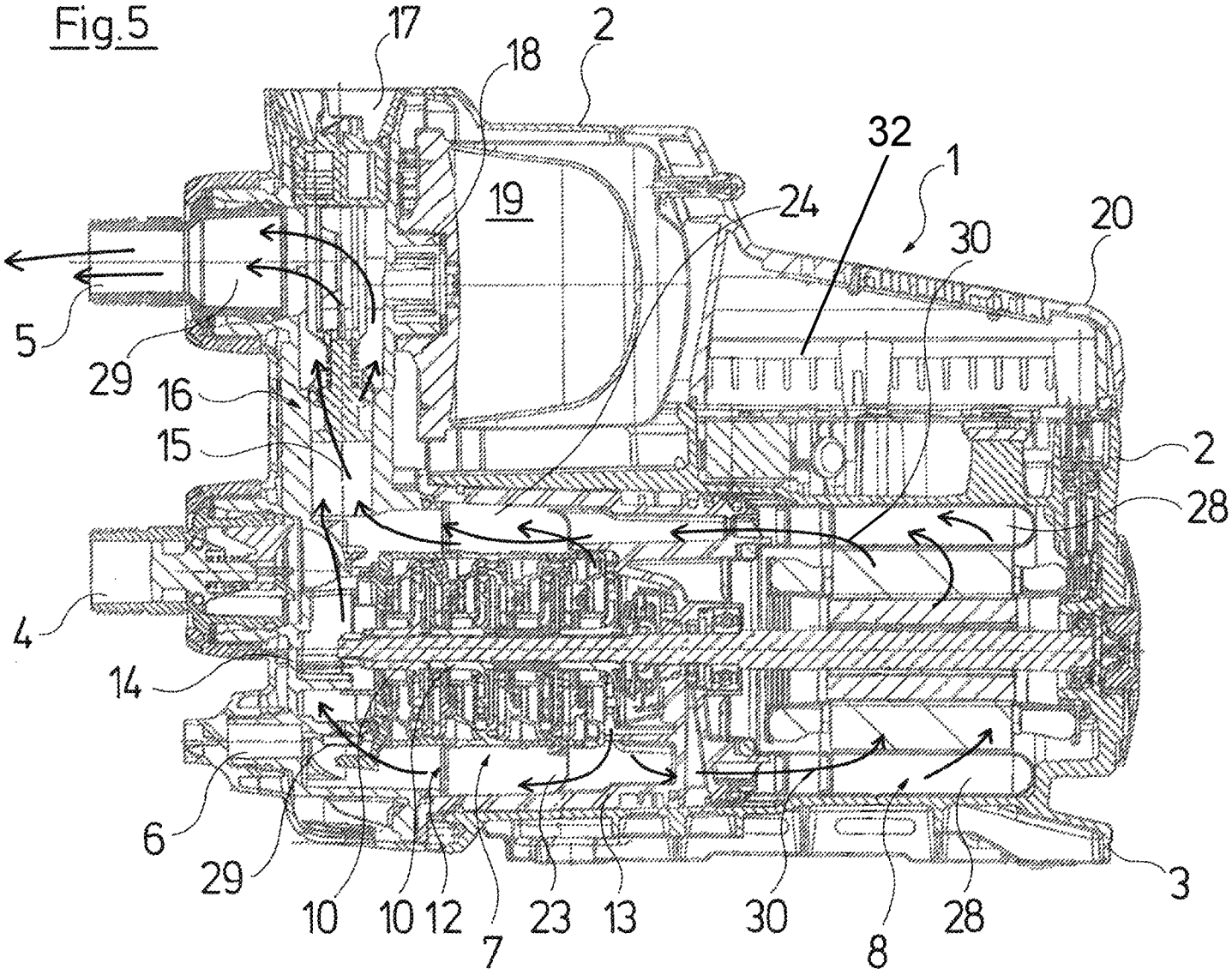
FIG. 5 is a greatly simplified longitudinal sectional view according to FIG. 1, showing a course of the delivery flows within the water supply system, on operation.

Referring to the drawings, a water supply system 1 comprises a housing 2, in which all components of the water supply system are integrated and which has a foot 3, with which the water supply system 1 stands on a floor surface for example, and, as the case may be, is anchored in this for example by screws.

The water supply system 1 at its housing side which is on the left in FIG. 1 comprises a suction connection 4 as well as a delivery connection 5 at a distance thereabove. A closable drain opening 6 is provided below the suction connection 4.

The lower part of the housing 2 is filled out by a multi-stage centrifugal pump 7 and an electric motor 8 which drives this, and these are arranged in a lying manner which is to say have a shaft 9 which is horizontal in operation, and which on the one hand receives the rotor of the electric motor 8 and on the other hand impellers 10 of the centrifugal pump 7.

The centrifugal pump which here has four stages is designed in a closed manner in the first three stages, which means that the diffuser connecting to the respective impeller is surrounded by a cylinder wall 11 forming the inner wall of an annular space 12, whose outer wall is formed by the pump casing. The pump casing is essentially formed from two casing parts, specifically a pot-like casing part 13 as well as a casing part 14 forming the suction port of the pump. The casing part 14 is designed as a plastic injection molded part, forms the side of the water supply system 1 which comprises the suction connection 4 and the delivery connection 5, and comprises a channel 15 which leads from the annular space 12 to the delivery connection 5 and which receives a non-return valve 16 and at its free end runs out at the upper side of the housing 2, where it is closed off by a closure plug 17. The delivery connection 5 connects to this channel 15 in a transverse manner downstream of the non-return valve 16 in the flow direction. A connection 18, on which a diaphragm tank 19 forming the pressure storage means of the water supply system 1 connects, is provided offset thereto by 180. The diaphragm tank 19 is arranged above the pump 7, and connecting to this at the rear side is an electronics housing 20 which is arranged above the electric motor 8 and receives the complete control and regulation electronics of the water supply system 1.

In operation, water gets through the suction connection 4 into the casing part 14, thus to the suction port of the pumps 7, from there subsequently through the individual pump stages up to the last impeller, from where it is diverted via the open diffuser yet described further below, in a main delivery flow 29, by 180 into the annular space 12, so as to get from there via the vertical channel 15 through the non-return valve 16 to the delivery connection 5 where it leaves the water supply system 1.

The last impeller 10 is surrounded by guide vanes 21 and 22, in order to produce a part flow which forms the cooling fluid flow 30 for the motor 8. With regard to the guide vanes 21 it is the case of common guide vanes which are arranged radially surrounding the impeller, and correspond to common guide vanes with regard to their design and function. The guide vanes 22 which are arranged in a manner offset by 180 (with respect to the rotation axis of the pump), are however extended in the axial direction to into the annular space 12, and divide the annular space 12 into two annular space parts, specifically a lower part-annular-space 23 and an upper part-annular-space 24. These guide vanes 22 which divide the annular space 12 extend axially from a face wall 25 of the pot-like casing part 13 along the outer wall up to close to the end of the casing part 13, thus where this is flanged onto the casing part 14. The guide vanes 22 reach inwards onto the cylinder wall 11, so that the annular space 12 is divided roughly horizontally by the guide vanes 22 at least in the region of the cylinder wall 11. The guide vanes 22 are designed inwards as is the case with the guide vanes 21, in the region of the last impeller.

A different pressure level in the part-annular-spaces 23 and 24 arises on operation due to the division of the annular space 12, at least in the region of the pot-like casing part 13, wherein a higher pressure prevail in the lower part-annular-space 23 than in the upper part-annular-space 24. The differences are comparatively low since the part-annular-spaces 23 and 24 are hydraulically connected towards the suction-side end of the annular space 12.

The pot-like casing part 13 comprises a central recess 26 for leading through and mounting the shaft 9. The face wall 25, in a manner surrounding this recess 26 extends up to the essentially cylindrical outer side of the casing part 13. Recesses 27 which lead to an annular space 28 which connects thereto and which surrounds the stator of the electric motor 8 are in this face wall 25, in the region flush with the annular space 12, in the lower part-annular-space 23 as well as in the upper part-annular-space 24. These recesses 27 serves for permitting the cooling fluid flow 30 which is produced by the different pressure level in the part-annular-spaces 23 and 24, to get from the lower part-annular-space 23 into the lower part of the annular space 28 surrounding the electric motor 8, and permitting it to flow upwards from there and through the upper recesses 27 in the face wall 25, into the upper part-annular-space 24, so as to get from there into the main delivery flow. This pressure difference between the lower and the upper part-annular-space 23, 24 and which is produced by the guide vanes 22 is sufficient to produce an adequate cooling fluid flow 30 through the annular space 28 and thus an adequate cooling of the electric motor 8.

While specific embodiments of the invention have been shown and described in detail to illustrate the application of the principles of the invention, it will be understood that the invention may be embodied otherwise without departing from such principles.

APPENDIX

List of Reference Numbers:

1 water supply system 20 electronics housing
2 housing of 1 21 normal guide vanes
3 foot 22 dividing guide vanes
4 suction connection 23 lower part-annular-space
5 delivery connection 24 upper part-annular-space
6 drain opening 25 face wall
7 centrifugal pump 26 central recess
8 electric motor 27 recesses in the face wall
9 shaft 28 annular space
10 impellers 29 main delivery flow
11 cylinder wall 30 cooling fluid flow
12 annular space
13 pot-like casing part of the pump casing
14 casing part of the pump casing
15 channel
16 non-return valve
17 closure plug
18 connection for the diaphragm tank
19 diaphragm tank

What is claimed is:

1. A centrifugal pump assembly for forming a part of a water supply system, the centrifugal pump assembly comprising:

an electric motor; and a single-stage or multi-stage centrifugal pump driven by the electric motor, said centrifugal pump comprising:

at least one impeller which produces a main delivery flow through an annular space surrounding at least one pump stage;

a space surrounding the electric motor, a cooling fluid delivery flowing through the space surrounding the electric motor; and at least two guide vanes, wherein the annular space is divided by the at least two guide vanes into part-annular-spaces, each of the part-annular spaces having a pressure level that is different than a pressure level of another one of the part-annular spaces when the at least one impeller is operated, and each part-annular-space being fluid conductively connected to the space surrounding the motor.

2. A centrifugal pump assembly according to claim 1, wherein the guide vanes are arranged diametrically in the annular space and form part of a last pump stage or are arranged after the last pump stage, the part-annular-spaces comprising a lower annular space and an upper annular space, wherein the at least two guide vanes deflect a portion of the main delivery flow to form a motor cooling flow of fluid, at least a portion of the motor cooling flow of fluid flowing in a direction opposite the main delivery flow, the lower annular space receiving the main delivery flow and the motor cooling flow of fluid, the motor cooling flow of fluid flowing in a first direction in the lower annular space, the upper annular space receiving the motor cooling flow of fluid, the motor cooling flow of fluid moving in a second direction in the upper annular space, the second direction being opposite the first direction.

3. A centrifugal pump assembly according to claim 1, wherein the annular space is delimited at least partly by a pump casing.

4. A centrifugal pump assembly according to claim 3, wherein the centrifugal pump is a multi-stage centrifugal pump with a last pump stage formed by the impeller with surrounding guide vanes in the pump casing and a first and any further pump stages are arranged within the cylinder wall which inwardly delimits the annular space of the pump and is divided in an axial direction at least in sections by the guide vanes.

5. A centrifugal pump assembly according to claim 1, wherein the guide vanes extend in one of a direction of a rotation axis of the impeller and in a direction parallel to the rotation axis of the impeller.

6. A centrifugal pump assembly according to claim 3, wherein the guide vanes extend into a region between the impeller and a face wall delimiting the pump casing.

7. A centrifugal pump assembly according to claim 6, wherein the fluid conductive connection comprises one or more conduit connections to the space surrounding the motor formed by one or more recesses in a face wall of the pump casing.

8. A centrifugal pump assembly according to claim 1, wherein the guide vanes extend radially along a face wall of a pump casing and extend axially along an outer wall of the pump casing, said outer wall outwardly delimiting the annular space.

9. A centrifugal pump assembly according to claim 1, wherein the pump is a radial centrifugal pump or a radial-axial centrifugal pump.

10. A centrifugal pump assembly according to claim 1, wherein the pump is configured for operation with a horizontally arranged rotation axis, and that the guide vanes subdividing the annular space of the pump extend essentially in a horizontal plane, in which the rotation axis also lies.

11. A centrifugal pump assembly according to claim 1, wherein the electric motor and the pump comprise a common shaft and the annular space of the pump is arranged aligned to the space which surrounds the motor.

12. A water supply system comprising a centrifugal pump assembly comprising:

an electric motor; and a single-stage or multi-stage centrifugal pump driven by the electric motor, said centrifugal pump comprising:

at least one impeller which produces a main delivery flow through an annular space surrounding at least one pump stage;

a space surrounding the electric motor, a cooling fluid delivery flowing through the space surrounding the electric motor;

at least two guide vanes, wherein the annular space is divided by the at least two guide vanes into part-annular-spaces, each of the part-annular-spaces having a pressure level that is different from a pressure level of another one of the part-annular-spaces during operation of the at least one impeller, and each part-annular-space is fluid conductively connected to the space surrounding the motor; and a housing surrounding the centrifugal pump, wherein a suction connection and a delivery connection are provided, which are arranged on a face side of the surrounding housing.

13. A water supply system according to claim 12, wherein the suction connection and the delivery connection are arranged above one another.

14. A water supply system according to claim 12, wherein:

the centrifugal pump assembly further comprises a diaphragm tank and motor electronics;

the electric motor is positioned in the housing; and the centrifugal pump and the electric motor are arranged at a bottom with the diaphragm tank and the motor electronics thereabove and at a top.

15. A water supply system according to claim 12, wherein the centrifugal pump is a multi-stage centrifugal pump with a last pump stage formed by the impeller with surrounding guide vanes in a pump casing and a first and any further pump stages are arranged within cylinder wall which inwardly delimits the annular space of the multi-stage centrifugal pump and is divided in an axial direction at least in sections by the guide vanes.

16. A water supply system according to claim 12, wherein the guide vanes extend into a region between the impeller and a face wall delimiting a pump casing, the part-annular-spaces comprising a lower annular space and an upper annular space, wherein the at least two guide vanes deflect a portion of the main delivery flow to form a motor cooling flow of fluid, at least a portion of the motor cooling flow of fluid flowing in a direction opposite the main delivery flow, the lower annular space receiving the main delivery flow and the motor cooling flow of fluid, the motor cooling flow of fluid flowing in a first direction in the lower annular space, the upper annular space receiving the motor cooling flow of fluid, the motor cooling flow of fluid moving in a second direction in the upper annular space, the second direction being opposite the first direction.

17. A water supply system according to claim 16, wherein the fluid conductive connection comprises one or more conduit connections to the space surrounding the motor formed by one or more recesses in a face wall of the pump casing.

18. A water supply system according to claim 16, wherein the guide vanes extend radially along a face wall of the pump casing and extend axially along an outer wall, of the pump casing, said outer wall outwardly delimiting the annular space.

19. A water supply system according to claim 16, wherein the pump is configured for operation with a horizontally arranged rotation axis, and that the guide vanes subdividing the annular space of the pump extend essentially in a horizontal plane, in which the rotation axis also lies.

20. A water supply system according to claim 19, wherein the electric motor and the pump comprise a common shaft with the rotation axis and the annular space of the pump is arranged aligned to the space which surrounds the motor.

* * * * *